US012611059B1

(12) United States Patent
Elawar

(10) Patent No.: US 12,611,059 B1
(45) Date of Patent: Apr. 28, 2026

(54) ERGONOMIC PILLOW FOR PREVENTING SLEEP WRINKLES

(71) Applicant: RR INVEST, Marseilles (FR)

(72) Inventor: Anwar Elawar, Marseilles (FR)

(73) Assignee: RR INVEST, Marseilles (FR)

( * ) Notice: Subject to any disclaimer, the term of this patent is extended or adjusted under 35 U.S.C. 154(b) by 15 days.

(21) Appl. No.: 18/969,962

(22) Filed: Dec. 5, 2024

(51) Int. Cl.
*A47G 9/10* (2006.01)
*A47G 9/02* (2006.01)

(52) U.S. Cl.
CPC ..... *A47G 9/10* (2013.01); *A47G 9/0253* (2013.01); *A47G 2009/1018* (2013.01)

(58) Field of Classification Search
CPC ..... A47G 9/10; A47G 2009/1018; A47G 9/0253; A61G 7/07; A61G 7/072; A61G 13/1205; A61G 13/121
USPC ..... 5/636, 622, 621, 490, 953, 948
See application file for complete search history.

(56) References Cited

U.S. PATENT DOCUMENTS 5,749,111 A * 5/1998 Pearce ..... B29C 48/11 428/137
6,026,527 A * 2/2000 Pearce ..... B29C 48/08 428/137
6,413,458 B1 * 7/2002 Pearce ..... A47C 27/15 264/141
7,060,213 B2 * 6/2006 Pearce ..... B29C 44/583 264/331.13
7,076,822 B2 * 7/2006 Pearce ..... B29C 48/022 5/655.5
7,886,388 B2 * 2/2011 Warren ..... A47C 27/15 5/730
8,359,689 B2 * 1/2013 Warren ..... A47C 27/144 5/730
D917,206 S * 4/2021 Taylor ..... D6/601
D917,927 S * 5/2021 Taylor ..... D6/601
D990,930 S * 7/2023 Taylor ..... D6/601
D991,706 S * 7/2023 Taylor ..... D6/601
12,350,919 B2 * 7/2025 Taylor ..... B32B 5/028
(Continued)

FOREIGN PATENT DOCUMENTS

DE 202006008768 U1 8/2006
EP 4306009 A1 * 1/2024 ..... A47G 9/109
(Continued)

*Primary Examiner* — Robert G Santos
(74) *Attorney, Agent, or Firm* — BUCHANAN, INGERSOLL & ROONEY PC

(57) ABSTRACT

An ergonomic pillow includes an upper layer composed of viscoelastic foam, a lower layer forming a base, supporting the upper layer, the lower layer including a structure formed of cells of hexagonal cross section, configured to distribute the weight resting on the whole structure of said pillow substantially equally, each cell being composed of a distal end and a proximal end, said distal ends forming a distal surface of the lower layer and said proximal ends forming a proximal surface of the lower layer, said distal and proximal ends of each cell being connected to one another by walls forming the thickness of said lower layer, the distal end of each cell having at least three slender reinforcement arms, each of said reinforcement arms connecting a vertex of the distal end of hexagonal cross section to the centre thereof so as to limit the shear effect against the user's skin.

11 Claims, 5 Drawing Sheets

(56) References Cited

U.S. PATENT DOCUMENTS

| | | | | |
|---|---|---|---|---|
| 2003/0096899 | A1* | 5/2003 | Pearce | C08K 5/0016 524/474 |
| 2004/0226098 | A1* | 11/2004 | Pearce | B29C 44/50 264/141 |
| 2004/0226099 | A1* | 11/2004 | Pearce | B29C 48/11 5/655.5 |
| 2005/0017396 | A1* | 1/2005 | Pearce | B29C 48/022 264/211.13 |
| 2006/0253988 | A1* | 11/2006 | Pearce | B29C 48/11 5/655.5 |
| 2010/0269262 | A1* | 10/2010 | Warren | A47C 27/15 5/690 |
| 2011/0154576 | A1* | 6/2011 | Warren | A47C 27/144 5/740 |
| 2020/0390247 | A1* | 12/2020 | Taylor | B32B 5/073 |
| 2023/0142851 | A1* | 5/2023 | Taylor | B32B 5/18 5/642 |
| 2023/0356496 | A1* | 11/2023 | Taylor | B29C 70/865 |
| 2023/0356497 | A1* | 11/2023 | Taylor | B32B 3/12 |
| 2025/0326202 | A1* | 10/2025 | Taylor | A47G 9/10 |

FOREIGN PATENT DOCUMENTS

| | | | | |
|---|---|---|---|---|
| FR | 3137551 | A1 * | 1/2024 | A47G 9/109 |
| WO | WO-2020252468 | A1 * | 12/2020 | B29C 70/865 |

* cited by examiner

[Fig. 1]
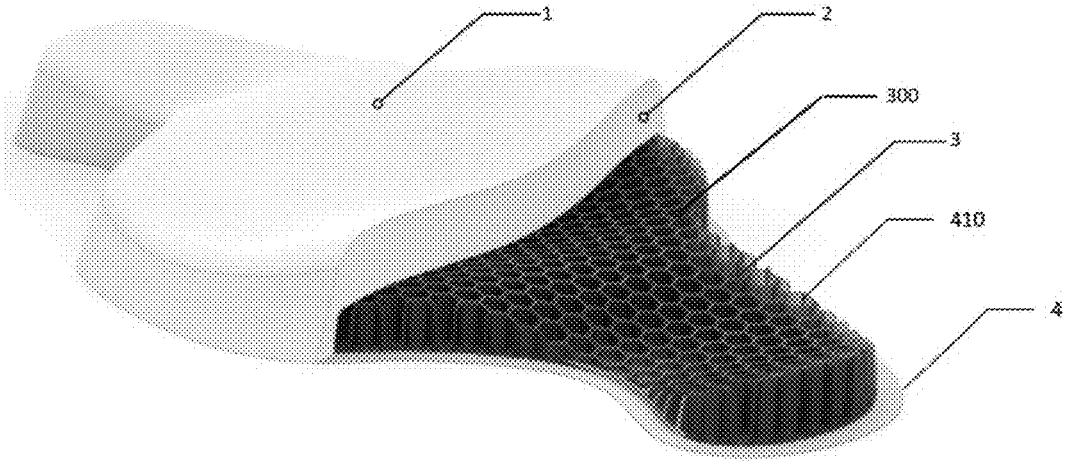
[Fig. 2]
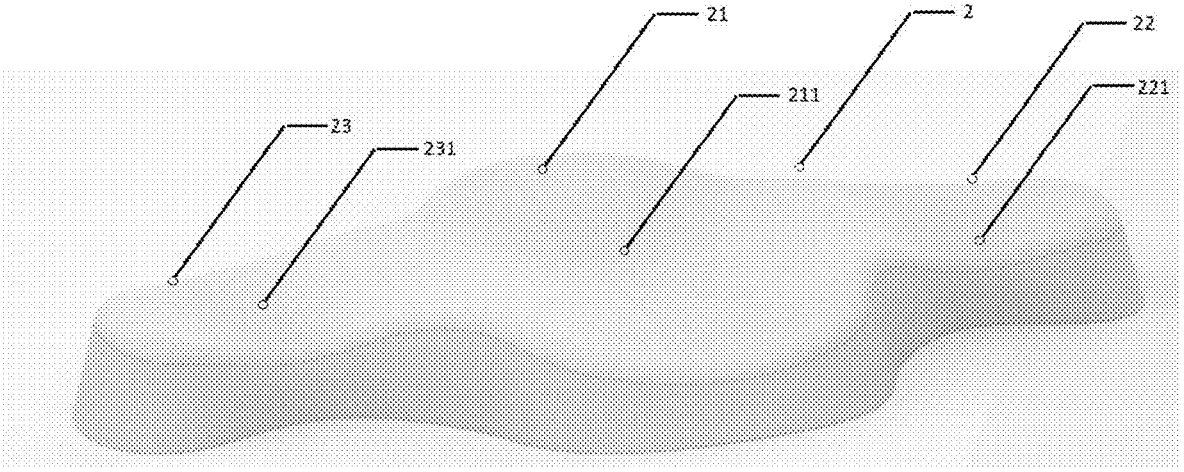

[Fig. 3]
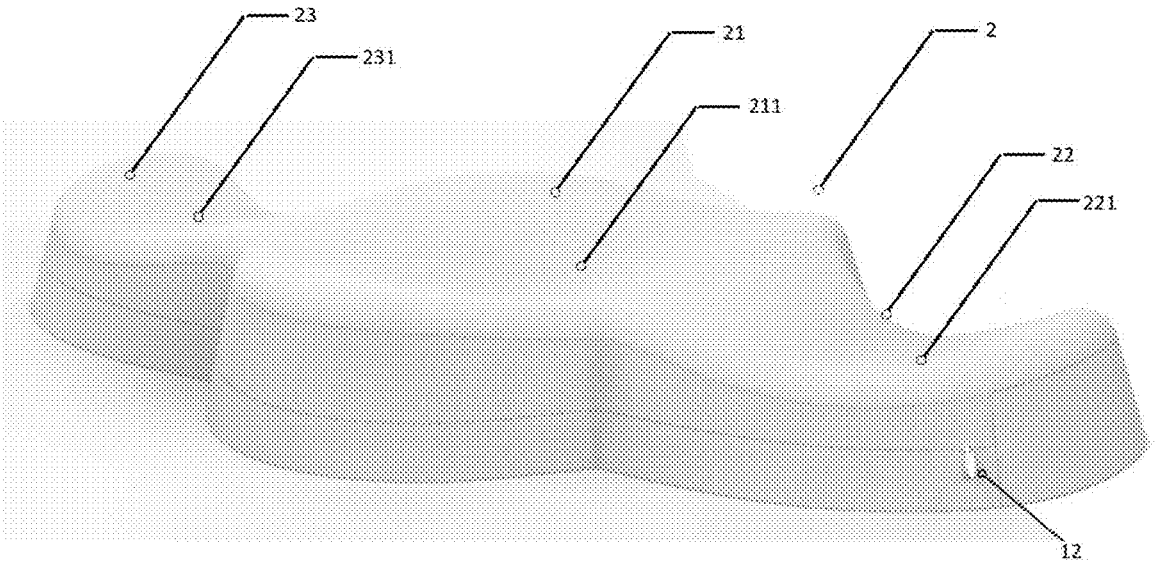
[Fig. 4]
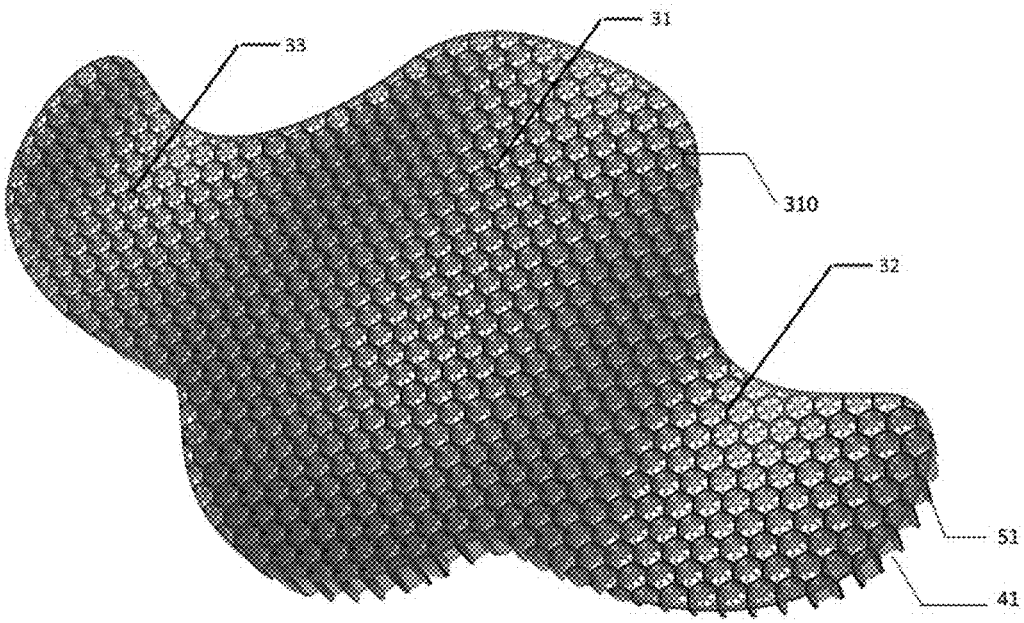

[Fig. 5]
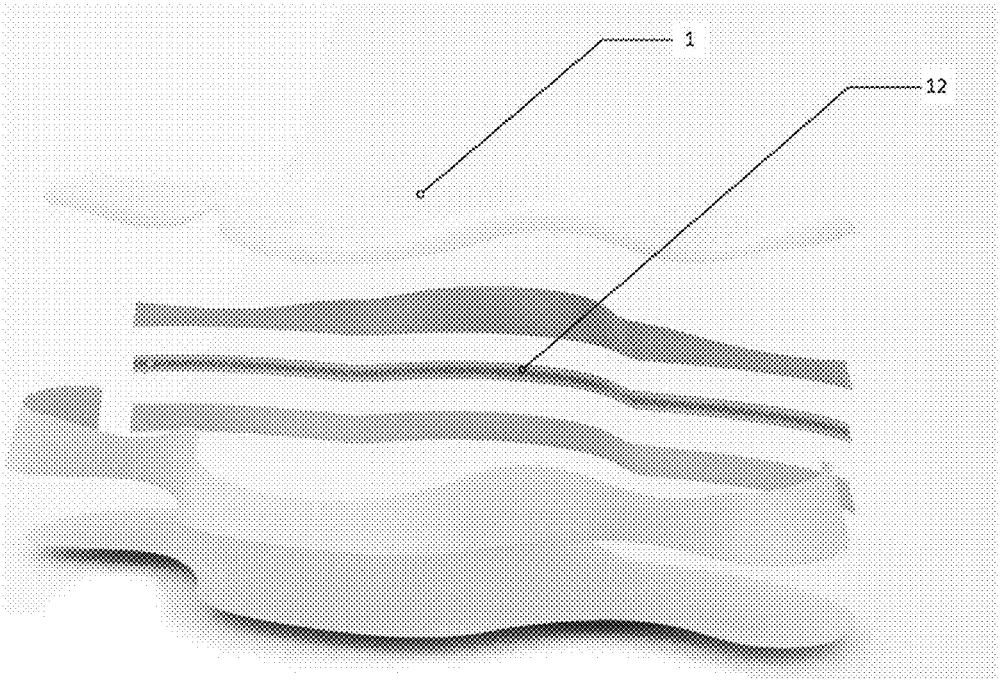

[Fig. 6]
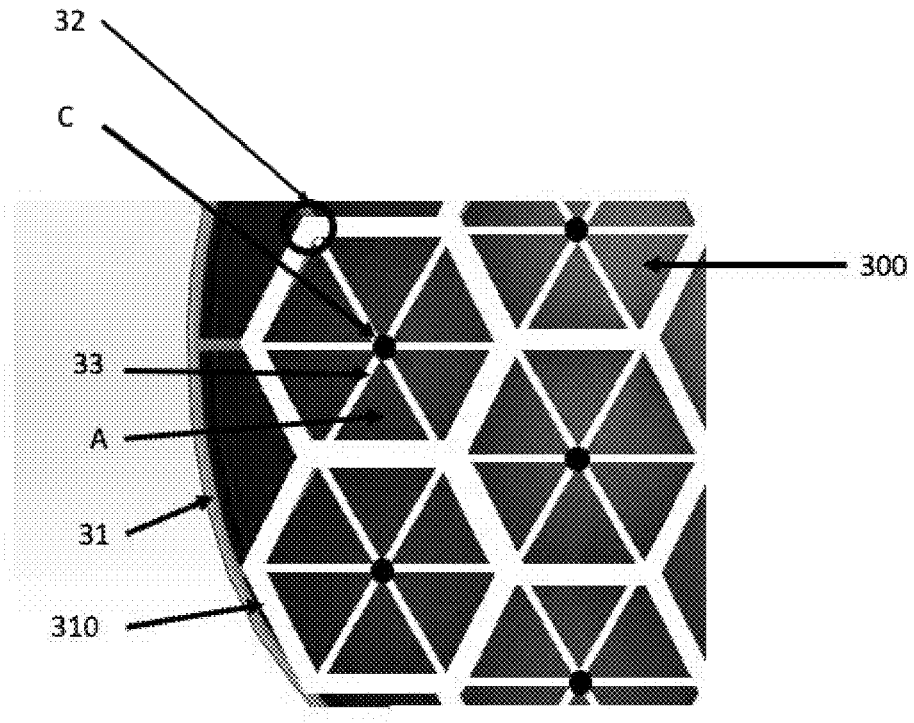

[Fig. 7]
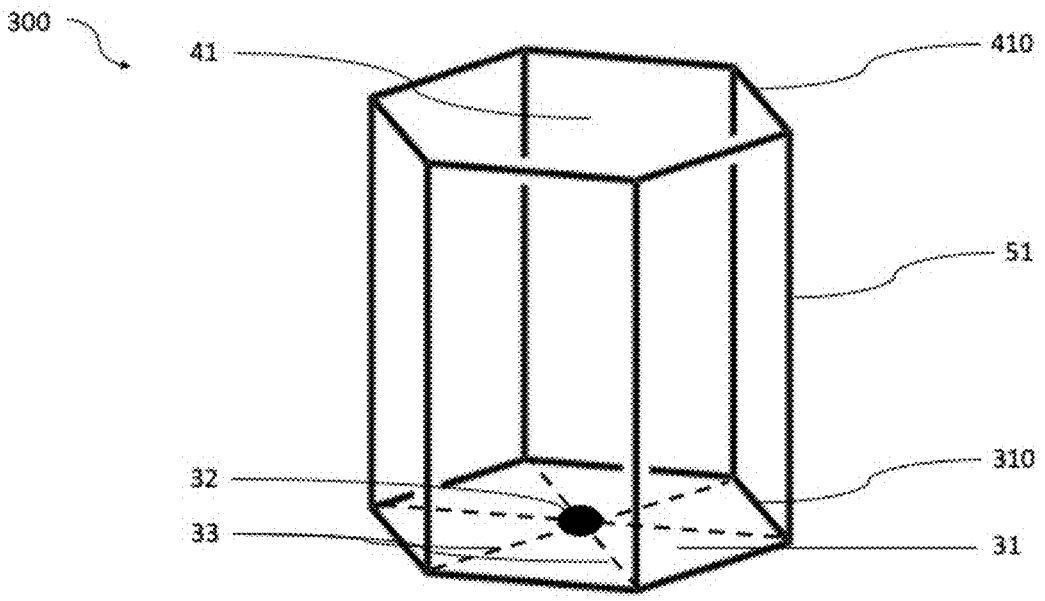

ERGONOMIC PILLOW FOR PREVENTING SLEEP WRINKLES

The present invention relates to an ergonomic pillow for preventing sleep wrinkles.

It has a general application in supporting a user's head during a sleep phase, and more particularly in reducing deleterious dermatological effects on the face of said user.

The compression that the skin of the face is subjected to during movement of the user's head is responsible for the formation of sleep wrinkles and damage the user's skin.

A great deal of progress has been made in the area of pillows, and in particular in the area of ergonomic pillows, and many pillow-type devices are focused on anatomical support making it possible to correctly support the user's neck and head.

These ergonomic pillows have the drawback of increasing the shear effect on the skin during movement of the user's head during sleep.

The shear effect on the skin is defined as the convergence of two opposite surface forces parallel to the skin. These two forces in general result from the friction of the skin when the patient slides on a support. The greater the shear effect is, the more it will cause a compression which will result in the formation of stresses on the dermis and epidermis or damage to the blood capillaries, and consequently the formation of sleep wrinkles.

Ergonomic pillows are known which are made of foam and contain a structure with a chosen shape having a central depression capable of receiving a user's head, as well as depressions arranged laterally and configured to receive the sides of a user's head performing a lateral rotation and thus, in combination with the use of a chosen foam-type material, it is made possible to reduce the compression of the skin of the user's face and thus the formation of sleep wrinkles.

These pillows have the drawback of having a very high shear effect and of focusing their technical effect on ergonomics designed to effectively reduce the formation of sleep wrinkles for a user.

Ergonomic pillow-type systems having a cellular structure made of silicone are also known which make a shape memory effect for adapting the shape of the pillow to a user's cervical anatomy possible.

Such ergonomic pillows with cells have the major drawback of limiting the support provided to the cervical region and head of a user, while having a high shear effect, and of not dealing with the formation or reduction of sleep wrinkles.

These problems are all the more considerable since the existing pillows are generally focused on cervical/anatomical support or on the reduction of the shear effect but do not deal with the combination of the two problems without one of them being only partially solved.

Document DE20062008768U teaches a cushion structure and, more particularly, a cushion structure with improved shape memory, which cushion structure comprises at least three separate support layers, each having a different elasticity. This has the drawback of not making it possible to reduce the shear effect of the pillow on the skin of the user's face while guaranteeing the stability and anatomical support of said user during a rotational movement of said user's head.

None of the known devices to date makes it possible to solve the two simultaneous problems of reducing the shear effect on the skin of the face combined with guaranteeing stability and anatomical support of said user during a rotational movement of said user's head.

The present invention overcomes these drawbacks.

The invention relates to an ergonomic pillow with shape memory comprising:

an upper layer composed of a viscoelastic foam of chosen density, configured to receive a user's head and to partially absorb and distribute the weight of the head on the upper contact surface of the pillow;

a lower layer forming a base, supporting the upper layer. Said lower layer comprises a structure of chosen density formed of cells of hexagonal cross section, configured to distribute the weight resting on the whole structure of said pillow substantially equally, each cell of hexagonal cross section being composed of a distal end and a proximal end, said distal ends of the cells forming a distal surface of the lower layer and said proximal ends of the cells forming a proximal surface of the lower layer, said distal and proximal ends of each cell being connected to one another by walls forming the thickness of said lower layer, said distal end of each cell having at least three slender reinforcement arms, each of said reinforcement arms connecting a vertex of the distal end of hexagonal cross section to the centre thereof so as to limit the shear effect against the user's skin.

In a preferred embodiment, the lower layer and the upper layer, when they are joined together, have a structure with a shape comprising a central part having a depression configured to receive the user's head, and at least two extensions integral with the central part and arranged laterally, each lateral extension having in each case a depression configured to receive the sides of the user's head when said head performs a lateral rotation, and capable of limiting all the more, in combination with said cells of the lower layer, the shear effects on the skin of the user's head during a lateral rotational movement of the head, the lower layer having a variable thickness following the shape of said pillow and being configured so that it is smaller at the centre of the depressions in relation to the edge of said depressions, said variation in thickness being gradual and configured to allow a deformation along tangential force lines in relation to the force applied by the movement of the user's head.

Advantageously, the Shore A hardness of the lower layer is comprised between 30 and 60 degrees.

In a preferred embodiment, the lower layer is made of a material belonging to the group formed by flexible moulded polyurethane rubber, silicone, or the like.

In a preferred embodiment, the upper layer is made of moulded polyurethane foam.

Advantageously, the density of the upper layer is comprised between 50 Kg/m3 and 90 Kg/m3.

Moreover, said pillow can have a third layer cooperating with the lower layer at the level of its distal surface, said third layer preferably being made of the same material as said upper layer.

As a variant, said upper layer can completely envelop said lower layer.

In addition, said ergonomic pillow can have an outer envelope made of bamboo fibre and configured to allow moisture to escape.

A second subject of the invention consists of an ergonomic bedding set which includes said ergonomic pillow according to the invention and a pillowcase configured to envelop said pillow.

Advantageously, said pillowcase is made of silk. Advantageously, the pillow according to the invention makes it possible to distribute the forces applied to the pillow while uniformly and gradually reducing the shear effects on the skin of the user's head during a movement, while guaranteeing optimum anatomical support.

The applicant has observed that the invention makes it possible to actively reduce the shear effect of the pillow on the skin of the user's face, while guaranteeing the stability and anatomical support of said user during a rotational movement of said user's head.

Moreover, the firmness of the material and of the structure of the pillow affects both the shear effect and the stability. In fact, the firmer a surface is, the greater the shear effect is. In contrast, a surface that is too flexible reduces the stability.

The cells are aligned with the extension of the body and flex depending on the movement so as to reduce the shear effect against the skin of the part of the body in contact with said pillow according to the invention.

Surprisingly, the applicant has observed that the combination of the lower and upper layers of the pillow according to the invention minimizes the shear effect, without sacrificing the stability and anatomical support of the user, and drastically reduces the conditions for forming sleep wrinkles.

Other advantages and characteristics of the invention will become apparent on examination of the description and the drawings, in which:

FIG. 1 diagrammatically shows the pillow according to the invention;

FIG. 2 diagrammatically shows a side view of the upper layer of the pillow according to the invention;

FIG. 3 diagrammatically shows a rear view of the upper layer of the pillow according to the invention;

FIG. 4 diagrammatically shows a top view of the lower layer of the pillow according to the invention;

FIG. 5 diagrammatically shows an exploded view of the cover of the pillow according to the invention; and FIG. 6 diagrammatically shows the specific structure of the cells on the distal surface of the lower layer according to the invention;

FIG. 7 diagrammatically shows the specific structure of one cell of hexagonal cross section.

With reference to FIGS. 1 to 7, the pillow 1 according to the invention comprises a lower layer 3 and an upper layer 2, configured to distribute the forces applied to said pillow 1 in use and to ensure a gradual deformation during a movement of the user.

The pillow 1 according to the invention comprises an upper layer 2, configured to receive a user's head and composed of a viscoelastic foam of chosen density, advantageously with shape memory, capable of at least partially absorbing and distributing the pressure exerted by the user's head on the upper contact surface of the pillow 1, and at least in part absorbing the applied forces. By way of non-limitative example, the density of the upper layer 2 is advantageously comprised between 40 and 90 kilograms per cubic metre, ideally 40 to 50 kilograms per cubic metre.

By way of non-limitative example, the upper layer 2 is made of injection-moulded polyurethane PU foam. Advantageously, the internal structure, usually a honeycomb structure, of this material makes it extremely breathable, preventing moisture and bad odours from stagnating. Furthermore, being a natural material, it has the advantage of being totally antibacterial and hypoallergenic.

Said upper layer 2 also has the advantage of adapting to the curves and lines of the head, neck and shoulders, an advantage which will be described later in the present description.

As mentioned above, said pillow 1 according to the invention also comprises a lower layer 3 forming a base and capable of supporting the upper layer 2. Said lower layer 3 comprises a structure of chosen density formed of cells 300 and configured to distribute the weight resting on the whole structure of said pillow 1 substantially equally.

The structure of cells 300 of the lower layer 3 is also configured to adopt semi-rigid properties along a vertical axis, while retaining deformable properties along the other axes in space, and capable of limiting the mechanical resistance and the local densification of said pillow 1 during a lateral rotational movement of the user's head, and thus making it possible to limit the shear effect against the user's skin.

In connection with FIGS. 4, 6 and 7, a structural description of said lower layer 3 is to be revisited. In this respect, as illustrated in said figures, said lower layer 3 has cells 300 of hexagonal cross section A. By "hexagonal" in the present description is meant hexagonal structures of cross section A advantageously comprised between 10 and 40 millimetres. Said lower layer 3 thus has a regular hexagonal cellular tessellation.

As illustrated in FIGS. 4 and 7, each cell 300 of hexagonal cross section A has a distal end 310, in this case the end of the cells 300 forming the surface of the lower layer 3 that is furthest away from the user's head when the pillow is placed on a surface in use, called the distal surface 31 hereafter, and a proximal end 410, in this case the end of the cells 300 forming the surface of the lower layer 3 that is closest to the user's head when the pillow is placed on a surface in use, called the proximal surface 41 hereafter. Said distal 310 and proximal 410 ends of each cell 300 are connected to one another via walls 51. The local thickness of said lower layer 3 is thus obtained through the elevation of said walls 51 from the distal end 310 towards the proximal end 410. In other words, each cell 300 has walls 51 describing the thickness of the lower layer 3, the so-called "distal" 310 and "proximal" 410 ends of said walls 51 of which respectively form the distal surface 31 and the proximal surface 41 of the lower layer 3. The presence of such walls 51 in the thickness of said lower layer 3 thus makes it possible to avoid a compression phenomenon of the pillow 1 when the user's head is positioned on said pillow 1.

As illustrated in FIGS. 6 and 7, each distal end 310 of each cell 300 of said lower layer 3 has its own structure, in this case at least three slender reinforcement arms 33 arranged so as to prevent torsion of the pillow 1 during a movement of the user when said pillow 1 is placed on a flat surface. To this end, each of said reinforcement arms 33 connects a vertex 32 of the distal end 310 of hexagonal cross section A to the centre C thereof so as to provide a stability when the pillow 1 is placed on a flat surface. In other words, it is precisely this specific hexagonal cellular structure of said lower layer 3 which makes it possible for the pillow 1 not to deform in torsion despite repeated movements of the user's head, thus reducing the shear effect on the skin of the user's face.

To this end, the cells 300 are compressed dynamically during a rotation of the user's head. Said cells 300 are compressed along a vertical axis while deforming along the plane of rotation of the user's head in order to guarantee a uniform and reduced restoring force, applied to the user's face, throughout the rotation or the movement. The pressure and shear effect is therefore greatly reduced and limits the local compression of the skin of the user's face, thus reducing the sleep wrinkles.

Advantageously, the cells 300 also make it possible for air to circulate freely and for moisture to escape, which contributes to preserving a moisture level and a chosen local temperature of the skin in contact with the pillow 1.

In practice, the cells 300 are semi-rigid and have an ability to deform by bending, advantageously making it possible to stimulate blood flow, and promote the circulation of the skin in contact with said pillow.

According to an embodiment, the lower layer 3 is made of a material belonging to the group formed by flexible moulded polyurethane rubber, silicone, or the like, and having a chosen hardness.

By way of non-limitative example, the Shore A hardness of the lower layer 3 is advantageously comprised between 30 and 60 degrees.

According to a preferred embodiment of the invention, the lower layer 3 and the upper layer 2 are joined together, in this case the upper layer 2 covers the lower layer 3 on its proximal surface 41, and form a structure with a shape describing a central part 21 having a depression 211, configured to receive the user's head, and at least two extensions 22, 23 integral with the central part and arranged laterally in relation to the central part 21, thus making it possible for the user to have an anatomical support, in this case a support that adapts to the morphology of the user's head, thus promoting their comfort.

In practice, each lateral extension 22, 23 has a depression 221, 231 configured to receive the sides of the user's head when said head performs a lateral rotation, and capable of limiting all the more, in combination with the cells 300 of the lower layer 3, the harmful effects of the shear on the skin of the user's head during a lateral rotational movement of the head, and more particularly on the user's face.

According to a preferred embodiment of the invention, the lower layer 3 has a variable thickness following the shape of said pillow 1 and configured so that it is smaller at the centre of the depressions 211, 221, 231 in relation to the edge of said depressions 211, 221, 231. By "thickness of the lower layer 3" is meant the height of the walls 51 of the cells 300.

In practice, said variation in thickness is gradual and configured to allow a deformation along tangential force lines in relation to the force applied by the user's head during movement and thus to reduce the compression and shear effect by limiting the force applied during the compression of the skin of the user's face.

In other words, the properties of resistance to pressure vertically, in combination with the deformability of the cells 300 on the other axes in space and the gradual reduction in the thickness of the lower layer 3 in order to follow the movement trajectory of the user's head, makes a gradual and sequential compression of the cells 300 possible and thus to reduce the pressure exerted locally on the skin.

In addition, for the user's comfort and so as to have a pillow 1 having a homogeneous outer appearance, said pillow 1 according to the invention can have a third layer 4, as illustrated in FIG. 1, cooperating with the lower surface 31 of the lower layer 3 forming a base, this third layer 4 preferably being made of the same material as the upper layer 2, in this case of a viscoelastic foam of chosen density, advantageously with shape memory, capable of absorbing the weight of the user's head. As a variant, instead of having a third layer 4 as mentioned above, the upper layer 2 could envelop, like a wrapping, the lower layer 3 in its entirety, like a sandwich with the lower layer 3 forming the core/heart and the upper layer 2 forming the surround/outer casing.

In practice, the different layers making up said ergonomic pillow 1 can be joined by gluing or by any other method making a homogeneous joining possible: injection-moulding or other, the invention in no way being limited to this selection.

In addition, said pillow 1 can have an outer envelope composed of several panels of bamboo fibre fabric, joined in three dimensions, and configured to allow moisture to escape.

According to a second subject of the invention, an ergonomic bedding set comprises the pillow 1 according to the invention and also comprises a protection of the pillowcase type 12, configured to envelop the pillow 1 by substantially following the shape of said pillow 1. Advantageously, said pillowcase 12 is made of silk, a material valued for its beneficial effects on the skin, in particular because of the reduction in friction, sleep creases and the appearance of wrinkles as well as due to the fact that it does not absorb the night creams that the user may apply to their face in the evening before going to bed. In fact, silk is known for its breathable side.

By way of example, as illustrated in FIG. 5, the pillowcase 12 can comprise closure means capable of fastening the pillow 1 in said pillowcase 12.

Advantageously, the combination of the cellular structure of the lower layer 3 and its hardness and deformation properties, all making it possible to eliminate the pressure points on the user's skin while surrounding and supporting the anatomy, combined with its positioning in relation to the upper layer 2, which makes it possible to distribute the weight stresses in use, describes a technical effect obtained by functional and structural characteristics the combination of which produces an effect making it possible to solve the problem posed by the invention of minimizing the shear effect, without sacrificing the stability and anatomical support of the user, and drastically reduces the conditions for forming sleep wrinkles; it is therefore possible to obtain a personalized adjustment to each person while offering excellent stability.

Surprisingly, the pillow 1 according to the invention makes it possible to dynamically adapt the surface of contact with the user's head and to distribute the forces applied so as not to generate epidermal compression that is concentrated enough to crease and deform the user's skin and thus form sleep wrinkles.

The invention claimed is:

1. Ergonomic pillow with shape memory comprising:

an upper layer, composed of a viscoelastic foam of chosen density, configured to receive a user's head and to partially absorb and distribute the weight of the head on the upper contact surface of the pillow;

a lower layer forming a base, supporting the upper layer; wherein:

the lower layer comprises a structure of chosen density formed of cells of hexagonal cross section, configured to distribute the weight resting on the whole structure of said pillow substantially equally, each cell of hexagonal cross section being composed of a distal end and a proximal end, said distal ends of the cells forming a distal surface of the lower layer and said proximal ends of the cells forming a proximal surface of the lower layer, said distal and proximal ends of each cell being connected to one another by walls forming the thickness of said lower layer, the distal end of each cell having at least three slender reinforcement arms, each of said reinforcement arms connecting a vertex of the distal end of hexagonal cross section to the centre thereof so as to limit the shear effect against the user's skin.

2. Ergonomic pillow according to claim 1, for which the lower layer and the upper layer, when they are joined together, have a structure with a shape comprising a central part having a depression configured to receive the user's head, and at least two extensions integral with the central part and arranged laterally, each lateral extension having in each case a depression configured to receive the sides of the user's head when said head performs a lateral rotation and capable of limiting all the more, in combination with said cells of the lower layer, the shear effects on the skin of the user's head during a lateral rotational movement of the head, the lower layer having a variable vertical thickness following the shape of said pillow and configured so that it is smaller at the centre of the depressions in relation to the edge of said depressions, said variation in thickness being gradual and configured to allow a deformation along tangential force lines in relation to the force applied by the movement of the user's head.

3. Ergonomic pillow according to claim 1, for which the Shore A hardness of the lower layer is comprised between 30 and 60 degrees.

4. Ergonomic pillow according to claim 1, wherein the lower layer is made of a material belonging to the group formed by flexible moulded polyurethane rubber, and silicone.

5. Ergonomic pillow according to claim 1, wherein the upper layer is made of moulded polyurethane foam.

6. Ergonomic pillow according to claim 1, wherein the density of the upper layer is comprised between 50 Kg/m3 and 90 Kg/m3.

7. Ergonomic pillow according to claim 1, wherein said pillow also has a third layer cooperating with the lower layer at the level of its distal surface, said third layer being made of the same material as said upper layer.

8. Ergonomic pillow according to claim 1, wherein said upper layer completely envelops said lower layer.

9. Ergonomic pillow according to claim 1, wherein said pillow has an outer envelope made of bamboo fibre and configured to allow moisture to escape.

10. Ergonomic bedding set including said ergonomic pillow according to claim 1 and a pillowcase configured to envelop the pillow.

11. Ergonomic bedding set according to claim 10, wherein said pillowcase is made of silk.

* * * * *